United States Patent [19]

Boettcher

[11] 4,258,860

[45] Mar. 31, 1981

[54] VENDING MACHINE WITH ADJUSTABLE DIVIDER IN HELICAL CONVEYOR

[75] Inventor: William C. Boettcher, Foley, Mo.

[73] Assignee: D.O.V.E. Equipment Corporation, Winfield, Mo.

[21] Appl. No.: 35,421

[22] Filed: May 2, 1979

[51] Int. Cl.[3] ..... G07F 11/36

[52] U.S. Cl. ..... 221/75

[58] Field of Search ..... 221/75, 241, 242; 198/659, 661, 670

[56] References Cited

U.S. PATENT DOCUMENTS

| | | | |
|---|---|---|---|
| 3,441,174 | 4/1969 | Kenney | 221/75 |
| 4,149,653 | 4/1979 | Lennartson | 221/75 |

*Primary Examiner*—Stanley H. Tollberg

*Attorney, Agent, or Firm*—Gravely, Lieder & Woodruff

[57] ABSTRACT

This invention involves an adjustable divider for vending machine helix discharge units. The units are used to store and dispense packaged objects such as chip products, candy, mints, chewing gum, candy bars, cigarettes, cigars, etc. The unit basically comprises a large rotatable helix dispensing spindle having a central divider within the convolutions of the helix which can be adjusted from horizontal to vertical and which divides the helix into separate side by side compartments. The size of the compartments is determined by the position of the center divider, the two compartments being largest when the divider is vertical and smallest when it is horizontal. The compartments are varied in size to accommodate different size packages.

15 Claims, 8 Drawing Figures

FIG. 1
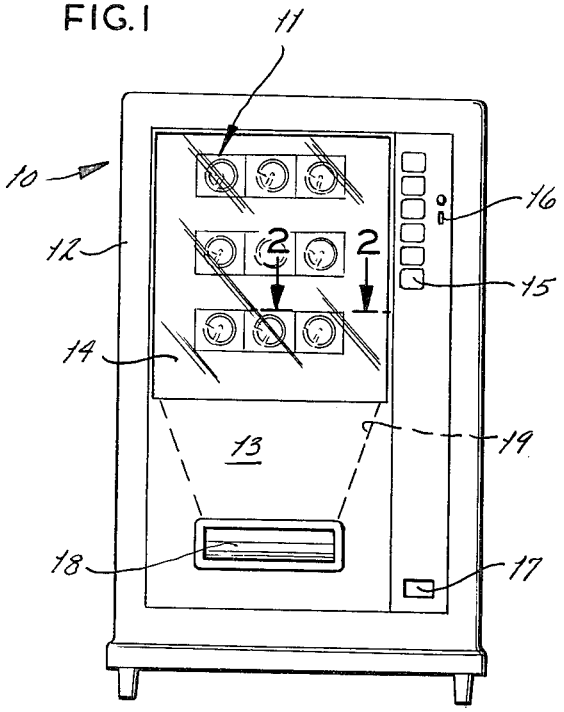
FIG. 2
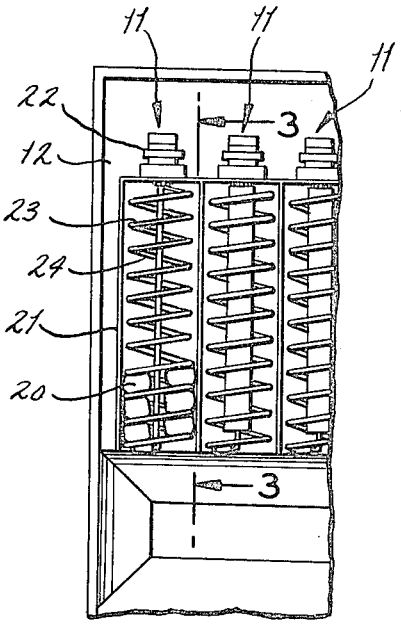
FIG. 3A
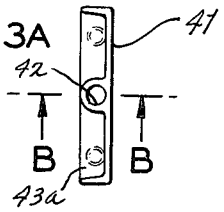
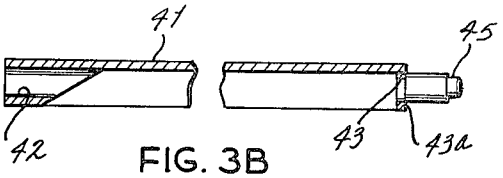
FIG. 3B
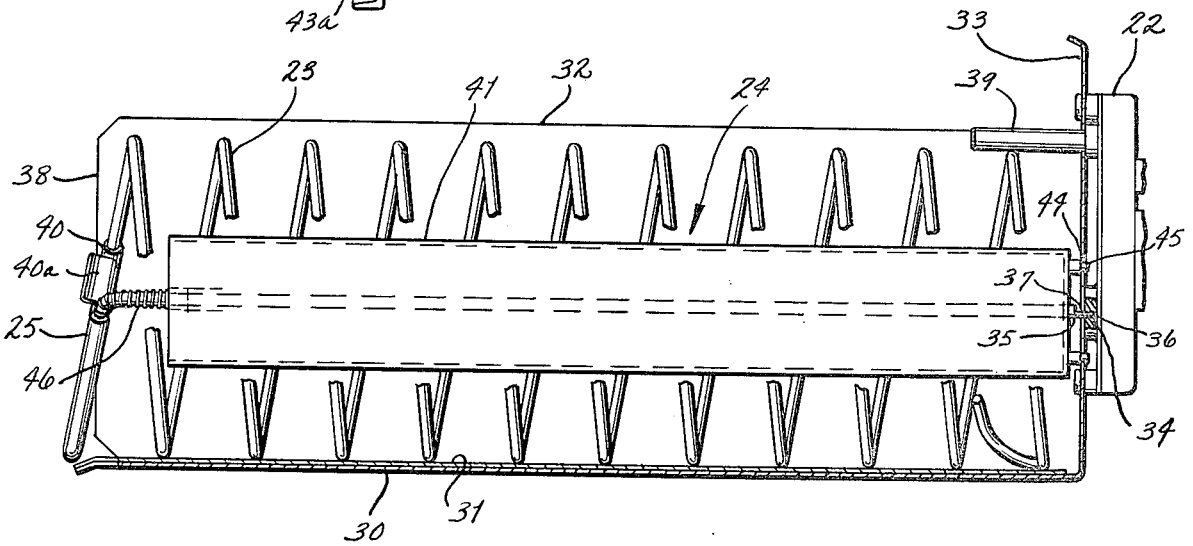
FIG. 3

VENDING MACHINE WITH ADJUSTABLE DIVIDER IN HELICAL CONVEYOR

BACKGROUND OF THE INVENTION

This invention relates generally to vending machines and more particularly to those which utilize a large helical coil to advance items from a storage position within the machine to a chute for discharge to the consumer. U.S. Pat. Nos. 3,178,055, 3,335,907, and 3,601,281 disclose various vending machines of this type. The machines usually have a discharge chute mounted on the front or at the side and are designed to hold a plurality of individual item discharge units. The units each have a tray with a helical coil mounted therein. Items are advanced by rotation of the coil by means of a motor activated by the customer after money is deposited in the machine.

Economy of manufacture dictates that the individual units, and hence the trays, be of identical construction. The consumer, however, demands that a wide range of products be made available to him through vending machines. The size and shape of the packaging for these various products varies from the typical sack for potato chips and the like, to packages of various sizes for cigarettes, and to still other packages for thin or little cigars, mints, lifesavers, gume and other products.

The problem for a manufacturer, therefore, is to provide a standard-sized tray, based quite often on a size necessary for vending cigarette packages, which is readily convertible to handling the smaller mint, gum, or candy bar packages.

While there are various methods for changing the size of the compartments, these earlier devices all result in compartments of fixed size, so that if the operator of the machine wished to change the size on site he needs to disassemble the entire unit and possibly has to take the unit back to his base of operations. It is quite desirable that a method be provided for adjusting the size of the units at the site, so that popular items can be increased in a particular machine even if they happen to differ in size from the items currently vended from the machine.

Among the patents which have attempted to utilize a space of some sort to reduce the size of the compartments are Wirstlin et al U.S. Pat. No. 3,908,858, Wittern U.S. Pat. No. 3,861,561 and Wittern U.S. Pat. No. 3,929,255. However, none of these units is completely adjustable on site and does not achieve all of the objects and advantages of the present invention.

Accordingly, it is a principal object of the present invention to provide a vending machine item discharge unit having adjustable means positioned within a rotatable discharge helix for changing the size of the merchandise holding compartments within the unit. Another object of the present invention is to provide a simple adjustment means which can be utilized to change the size of storage compartments in a helix delivery system and which can be used whether the helix is front driven or rear driven. These and other objects and advantages will become apparent hereinafter.

SUMMARY OF THE INVENTION

The present invention comprises a vending machine unit in which a helix turns in a tray to progress items toward the open end of the tray and which incorporates an adjustable divider means within the heliz to change the spacing between the side walls of the tray and the edges of said divider, whereby articles of different widths can be accomodated in the convolutions of the helix.

In the drawings wherein like numbers refer to like parts wherever they occur.

FIG. 1 is a front elevational view showing a vending machine having the individual units of this invention incorporated therein;

FIG. 2 is a sectional view taken along line 2—2 of FIG. 1 showing several of the individual vend units of this invention in plan;

FIG. 3 is a vertical sectional view taken along line 3—3 of FIG. 2;

FIG. 3A is an end view of the shelf;

FIG. 3B is a foreshortened sectional view of the shelf of FIG. 3A taken along line B—B of FIG. 3A.

Figure 4:
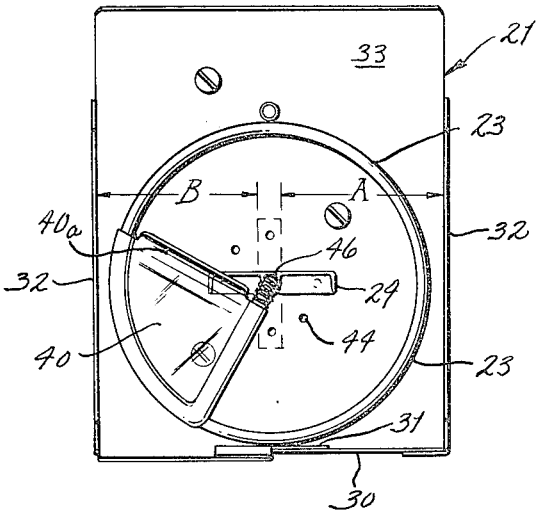
FIG. 4 is an end elevational view of a single dispensing module shown in FIG. 3 with the shelf in a horizontal position.

In a preferred embodiment, the present invention is embodied in a vending machine 10 (FIG. 1) having a plurality of helix discharge units indicated generally by the numeral 11 which preferably are disposed in side by side horizontal and/or vertical relationship within the storage compartment portion of the machine 10. If desired the units 11 can be used individually, but the more usual arrangement is a bank within a cabinet 12 as shown. The cabinet or storage compartment 12 includes a front door 13 having a clear see-through window portion 14 through which the customer may view the merchandise residing in the units 11. Mounted on the machine 10 are selection means 15 which activate the individual units 11, a coin slot 16 and a coin return 17. A discharge opening 18 positioned at the lower portion of the door 13 is connected to a discharge chute 19 which connects with the open front end of the vend units 11.

A plurality of packaged items 20, such as rolls of mints, packages of gum, or the like are positioned within each helix discharge unit 11 (FIG. 2). The discharge units 11 are designed so that they can be moved into or out of the cabinet 12 for refilling. Each of the units 11 is similar and preferably comprises a tray assembly 21, a drive unit 22, a helix 23, and an adjustable divider mechanism 24.

In the form of the invention shown in FIGS. 1-4, the helix 23 is known as a front driven helix which means that there is a positive connection between the drive means 22 and the leading edge 25 of the helix 23.

The tray assembly 21 comprises a bottom wall 30, which preferably has a plastic layer 31 of teflon or the like positioned along the upper side of the bottom wall 30 so that the helix 23 rotates on the sheet 31. This protects the surface of the bottom wall 30, which may be painted, and also acts as a friction and power consumption reducing element for the helix 23.

The tray assembly unit 21 further comprises side walls 32 and a rear wall 33. The drive unit 22 is attached to the back side of the rear wall 33 and has a drive shaft 34 in which a drive rod 35 is positioned and caused to rotate therewith by means of a flattened surfaces 36 and 37. The drive rod is an extension of the leading edge of the helix 23 and is enclosed in the divider unit 24. Thus, when the drive unit 22 is energized, the drive shaft 34 rotates the drive rod 35 and consequently the leading edge 25 of the helix 23 is rotated to propel the packages 20 stored within the convolutions of the helix 23 toward the open end 38 of the tray assembly 21. The outermost package 20 is propelled out of the tray assembly 21 into the discharge chute 19. The unit is set up so that a package is discharged with each 180° rotation of the helix 23.

Preferably a small diameter dowl pin 39 is positioned in the rear wall 33 and extends slightly above the rear end of the helix 23. The pin 39 extends sufficiently forward to extend over the last convolution of the helix 23 when said last convolution is at its forward most progression. The pin 39 acts to keep the rear of the helix 23 down against the tray floor 30 to prevent products from being driven beneath the helix 23, thus jamming the vending system.

A clear plastic member 40 is positioned in the last quadrant of the helical member 23 to aid in locating the drive rod 35 in the center of the helix 23. The member 40 has an outturned lip 41 to cam the last package backward toward the helix to prevent small packages from becoming wedged in the discharge mechanism, thus causing the machine to become inoperative.

The divider 24 is incrementally adjustable between horizontal and vertical positions so as to provide a means for adjusting the width of the side by side compartments A and B defined between the divider 24 and the tray side walls 32. The divider mechanism 24 comprises a U-shaped rectangular body 41, preferably formed from plastic or other suitable material. The drive rod 35 is positioned within the center of the divider body 41 and is journaled in a retaining member 42 on the leading edge and in an opening 43 in a rear wall 43*a* of the divider body 41. The openings 42 and 43 cradle and retain the drive rod 35 in the body 41 and act as bearing surfaces for rotation of the body 41 about the rod 35.

Positioned at the tray rear wall 33 are spaced opposed openings 44 which will align with locating pin means 45 positioned at the rear edge of the divider body 41. A spring 46 or like resilient means is disposed between the front edge of the divider body 41 and the clear plastic member 40 surrounding the drive rod 35. The spring 46 urges the divider body 41 toward the rear wall 33 and maintains the divider body 41 positioned in engagement with the openings 44 to secure the divider body 41 in fixed position with respect to the rear wall 33.

To adjust the position of the divider body 41, the divider body 41 first is pulled forward, withdrawing the studs 45 from the openings 44 against the pressure of the spring 46. The divider body 41 then is rotated until the studs 45 are in alignment with a second set of openings 44. The final step in adjusting the body 41 is reengaging the studs 45 with such second set of openings 44. Thus, the divider mechanism 24 has effectively changed the size of the openings A and B between the edges of the divider body 41 and the tray side walls 32, so that a different size package can be accomodated between the convolutions of the helix 23.

Figure 5:
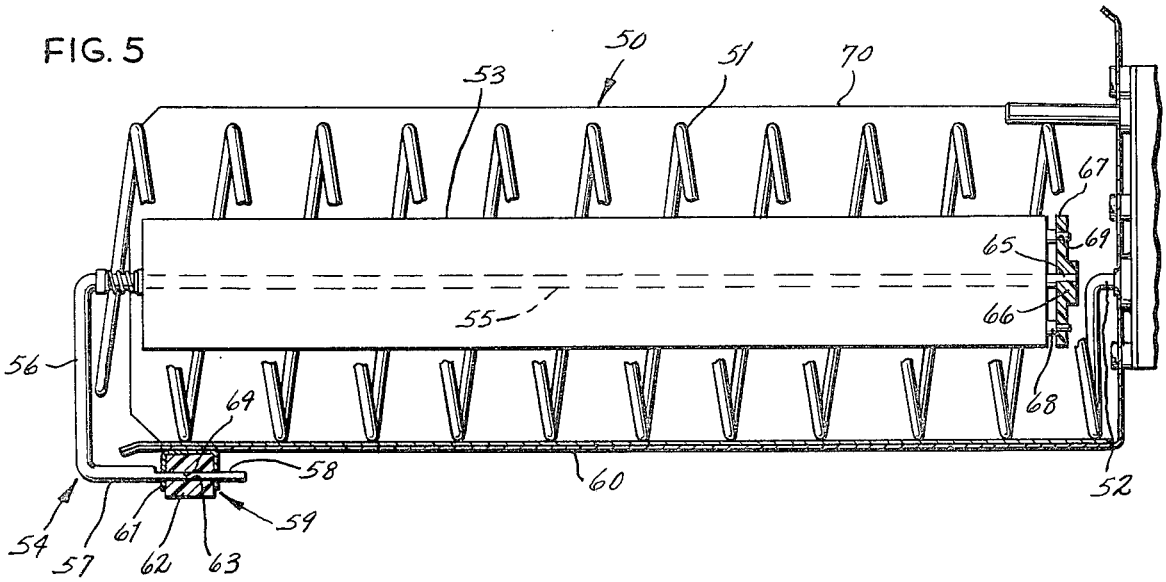
FIG. 5 is a plan view of a modification of the present invention utilizing a rear drive for the helix.
Figure 6:
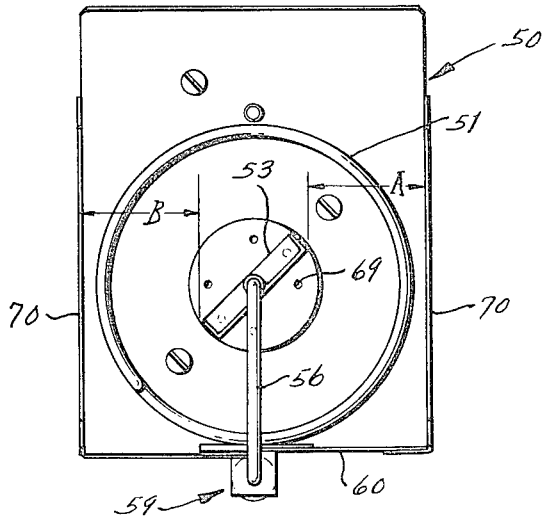
FIG. 6 is an end elevational view of the modification shown in FIG. 5.

A modification of the invention is shown in FIG. 5 and 6 and comprises a tray 50 having a helix 51 which is driven from the rear by means of a drive rod 52 which is an extension of the last coil of the helix 51. To support a divider body 53, a U-shaped support member 54 is mounted on the tray 50. The support member 54 comprises an elongated upper leg 55, a bight portion 56 and a lower leg 57 having a flattened portion 58 adjacent to the free end. A support member 59 is mounted beneath the tray floor 60, and comprises a bracket 61 containing a synthetic polymeric retainer member 62. The retainer member 62 has an opening 63 therein with a flattened portion 64 which frictionally mates with the flattened portion 58 of the support leg 57 to fixedly mount the support member 54 and the adjustable divider 53 to the tray 50. Any suitable support means can be used to connect the tray 50 to the self divider 53.

The elongated leg 55 of the support member 54 has a reduced section 65 at its free end which is engaged with central hub 66 of a nonrotating lock member 67 to fix the position of the support leg 55 with respect to the tray 50. The divider body 53 is provided with studs 68 which project outwardly from the trailing edge thereof to engage openings 69 positioned within the periphery of the nonrotating lock member 67 to fix the position of the divider body 53 with respect to the tray 50. Thus if the divider studs 68 are withdrawn from the lock wheel openings 69 and the body 53 is rotated around the elongated leg 55 of the support member 54, the effective width of the divider member 53 is changed, so as to change the distance between the edges thereof and the tray side walls 70. This changes the size of the compartments A and B defined between the divider 53 and the tray side walls 70.

What is claimed:

1. A vending machine item discharge unit comprising:

(a) a tray having side, rear and bottom walls;

(b) helical means having a plurality of convolutions along its length to retain articles to be dispensed in the convolutions;

(c) drive means connected to the helical means to rotate said helical means in predetermined increments upon activation by a customer, and (d) adjustable divider means positioned within the helical means dividing the helical means into compartments of substantially equal width and movable to change the spacing between the tray side walls and said divider means to compensate for articles of different width in the convolutions of the said helical means while maintaining the compartments of substantially equal size.

2. The unit of claim 1 wherein the helical means is connected to the drive means through the leading edge of the helix.

3. The unit of claim 2 wherein the connection between the leading edge of the helix and the drive means is a drive rod extending between the leading edge of the helix and the drive means around which the divider means is rotatable between fixed positions.

4. The unit of claim 3 wherein the divider means has studs projecting rearwardly thereof and aligned and engagable with opening around the drive means to fix the position of the divider with respect to the tray rear and side walls.

5. The unit of claim 4 including resilient means urging the divider means into engagement with the openings around the drive means.

6. The unit of claim 5 wherein the resilient means is interposed between the leading edge of the divider and a stop means on the drive rod and helix.

7. The unit of claim 1 wherein the helical means is connected to the drive means by an extension of the lastmost helical turn in the tray.

8. The unit of claim 7 wherein the divider means is rotatably positioned in the helix by means of a support member fixed with respect to the tray.

9. The unit of claim 8 wherein the support member is a U-shaped member having a leg anchored to the tray and a leg positioned in the helix rotatably supporting the tray so that the divider can be moved between fixed positions with respect to the support and with respect to the tray.

10. The unit of claim 9 including an anchor bracket mounted on the leg of the support member on which the divider is mounted, said anchor having openings located around the center thereof, the divider having studs on the rearward edge aligned with the openings in the anchor so that the position of the divider is fixed with respect to the tray walls when the studs are engaged in said openings.

11. The unit of claim 10 including resilient means urging the divider toward the anchor.

12. The unit of claim 11 wherein the resilient means surrounds the divider support leg of the support member and is interposed between a stop thereon and the leading edge of the divider.

13. The unit of claim 1 including retaining means engaging the rearmost convolution of the helix to restrain the helical means in the tray.

14. The unit of claim 13 wherein the retaining means is a dowel which is fixed to the rear wall of the tray and extends over the rearmost convolution of the helix when it is in its forwardmost progression and restrains the helix against the floor of the tray.

15. The unit of claim 1 wherein the divider means is rotatably movable between horizontal and vertical.

* * * * *